US009459649B2

(12) United States Patent
Wurn et al.

(10) Patent No.: US 9,459,649 B2
(45) Date of Patent: Oct. 4, 2016

(54) ACTIVE FORCE PEDAL ASSEMBLY

(71) Applicants: Michael L. Wurn, Osceola, IN (US); Yulanda Wang, Amherst, NY (US)

(72) Inventors: Michael L. Wurn, Osceola, IN (US); Yulanda Wang, Amherst, NY (US)

(73) Assignee: CTS CORPORATION, Elkhart, IN (US)

( * ) Notice: Subject to any disclaimer, the term of this patent is extended or adjusted under 35 U.S.C. 154(b) by 252 days.

(21) Appl. No.: 14/200,136

(22) Filed: Mar. 7, 2014

(65) Prior Publication Data

US 2014/0260767 A1 Sep. 18, 2014

Related U.S. Application Data

(60) Provisional application No. 61/789,111, filed on Mar. 15, 2013.

(51) Int. Cl.

| | |
|---|---|
| ***G05G 1/30*** | (2008.04) |
| ***G05G 5/03*** | (2008.04) |
| ***G05G 1/40*** | (2008.04) |
| ***G05G 1/44*** | (2008.04) |

(52) U.S. Cl.
CPC *G05G 1/40* (2013.01); *G05G 1/44* (2013.01); *G05G 5/03* (2013.01); *Y10T 74/20528* (2015.01)

(58) Field of Classification Search
CPC ..... G05G 1/44; G05G 1/30; G05G 1/445; G05G 1/506; G05G 1/46; G05G 1/48; G05G 1/483; G05G 5/03; G05G 1/38; G05G 1/40; B60T 7/042; B60T 7/04; B60T 7/06; Y10T 74/20528; Y10T 74/20534; H01H 3/14; H01H 21/26
USPC ..... 74/512–514, 560, 473.16; 200/61.89, 200/61.29, 86.5; 188/72.2, 72.7
See application file for complete search history.

(56) References Cited

U.S. PATENT DOCUMENTS

| | | | | |
|---|---|---|---|---|
| 7,318,361 | B2 | 1/2008 | Boutteville et al. | |
| 7,570,156 | B2 | 8/2009 | Cicilloni et al. | |
| 7,770,491 | B2 | 8/2010 | Ritter et al. | |
| 7,926,384 | B2 * | 4/2011 | Wurn | G05G 1/38 74/513 |

(Continued)

FOREIGN PATENT DOCUMENTS

| | | |
|---|---|---|
| DE | 29805253 | 7/1999 |
| DE | 10228652 | 1/2004 |

(Continued)

OTHER PUBLICATIONS

Aoki, J; Murakami, T., A Method of Road Condition Estimation and Feedback Utilizing Haptic Pedal, IEEE, Mar. 28, 2008, pp. 777-782.

(Continued)

*Primary Examiner* — Adam D Rogers
(74) *Attorney, Agent, or Firm* — Daniel Deneufbourg

(57) ABSTRACT

An active force pedal assembly that includes a housing for a pedal and a torque motor that is coupled to the pedal in a direct drive relationship via a shaft that extends between and is coupled directly to both the pedal and the torque motor. The drum of the pedal and the torque motor are disposed in a side-by-side relationship in which the respective longitudinal axes of the drum and the torque motor are co-linearly aligned. The torque motor generates and transfers a rotational torque force to the shaft which, in turn, applies an active force to the pedal and thus the foot of the operator of the vehicle for providing a sensory signal of a vehicular condition or event.

4 Claims, 3 Drawing Sheets

(56) References Cited

U.S. PATENT DOCUMENTS

| | | | | |
|---|---|---|---|---|
| 8,042,430 | B2 * | 10/2011 | Campbell | G05G 1/38 74/513 |
| 9,182,774 | B2 * | 11/2015 | Drews | B60K 26/021 |
| 2007/0000345 | A1 * | 1/2007 | Leone | 74/513 |
| 2011/0083528 | A1 * | 4/2011 | Osawa et al. | 74/513 |
| 2012/0096976 | A1 * | 4/2012 | Leone et al. | 74/513 |
| 2012/0137822 | A1 | 6/2012 | Kim et al. | |
| 2012/0167708 | A1 * | 7/2012 | Brandt | B60K 26/021 74/513 |
| 2012/0169488 | A1 * | 7/2012 | Thiel et al. | 340/438 |
| 2015/0232071 | A1 * | 8/2015 | Pelletier | B60T 7/045 477/194 |

FOREIGN PATENT DOCUMENTS

| | | | |
|---|---|---|---|
| DE | 102004002114 | | 8/2005 |
| DE | 202004004454 | U1 | 8/2005 |
| DE | 102009021585 | A1 | 12/2010 |
| DE | 102009058967 | A1 | 6/2011 |
| DE | 102011050056 | A1 | 11/2012 |
| DE | 102011054655 | | 4/2013 |
| DE | 2020013103011 | | 9/2013 |
| EP | 1375233 | | 1/2004 |
| EP | 1602520 | A2 | 12/2005 |
| EP | 2301788 | A2 | 3/2011 |
| EP | 2492130 | A2 | 8/2012 |
| EP | 2607139 | | 6/2013 |
| FR | 2910104 | | 6/2008 |
| JP | 2013119264 | A | 6/2013 |
| KR | 20090029949 | | 3/2009 |
| WO | 2013087254 | | 6/2013 |
| WO | 2013087259 | | 6/2013 |
| WO | 2013087261 | | 6/2013 |
| WO | 2013087265 | | 6/2013 |
| WO | 2013087266 | | 6/2013 |
| WO | 2013087267 | | 6/2013 |
| WO | 2013182339 | | 12/2013 |
| WO | 2013189648 | | 12/2013 |

OTHER PUBLICATIONS

De Rosario et al, Efficacy and Feeling of a Vibrotactile Frontal Collision Warning Implemented in a Haptic Pedal, Transportation Research Part F Traffic Psychology and Behaviour, Mar. 31, 2010, pp. 80-91.

Mulder, M et al., Design of a Haptic Gas Pedal for Active Car-Following Support, IEEE (vol. 12, Issue 1), Nov. 29, 2010, pp. 268-279.

* cited by examiner

ACTIVE FORCE PEDAL ASSEMBLY

CROSS REFERENCE TO RELATED AND CO-PENDING APPLICATION

This application claims the benefit of the filing date and disclosure of U.S. Provisional Patent Application Ser. No. 61/789,111 filed on Mar. 15, 2013, the contents of which are entirely incorporated herein by reference as well as all references cited therein.

FIELD OF THE INVENTION

The present invention relates to vehicle pedals in general and, in particular, to a vehicle pedal assembly incorporating an active force pedal.

BACKGROUND OF THE INVENTION

Vehicle accelerator/throttle pedals allow a vehicle operator to control the acceleration of a vehicle through either the application or removal of a foot force on the pedal. Pedals have also been developed that provide haptic feedback to the operator by applying an active push back force to the pedal and the foot of the operator in response to the sensing of a variety of vehicle conditions or events including, for example, the vehicle exceeding a recommended speed, or the vehicle not keeping a safe distance behind another vehicle, or the vehicle sensing the presence of an object behind the vehicle when operating in reverse.

The present invention is directed to a new active force pedal.

SUMMARY OF THE INVENTION

The present invention is directed to an active force pedal assembly comprising a housing, a pedal including an end mounted in the housing for pivotal movement relative to the housing, a torque motor adapted to generate a rotational force, and a shaft having a first end coupled to the pedal and an opposed end adapted for coupling with the torque motor. The rotational force generated by the torque motor is transferred to the shaft and results in the application of an active force on the pedal.

In one embodiment, the torque motor is located in the housing.

In one embodiment, a housing wall separates the torque motor and the pedal and the housing wall defines an aperture and the shaft extends through the aperture.

In one embodiment, the torque motor is a six pole torque motor connected to the pedal in a direct drive arrangement.

In one embodiment, electronics are integrated in the housing for controlling the torque motor.

In one embodiment, the active force pedal assembly is a non-contacting sensor pedal assembly.

In one embodiment, the end of the pedal mounted in the housing includes a drum, the drum of the pedal and the torque motor being disposed in a horizontal side-by-side relationship and defining respective co-linearly aligned longitudinal axes.

The present invention is also directed to an active force pedal assembly comprising a housing defining an interior cavity, a pedal including a drum extending into the interior cavity of the housing, the drum defining a longitudinal and rotational axis and adapted for pivotal movement in the interior cavity of the housing about the longitudinal and rotational axis relative to the housing, a torque motor adapted to generate a rotational force, the torque motor being located in the interior cavity of the housing and defining a longitudinal axis disposed in a co-linear relationship with the longitudinal and rotational axis of the drum of the pedal, and an elongate shaft in the housing having a first end extending into and coupled to the drum of the pedal and an opposed end extending into and adapted for coupling to the torque motor, the rotational force generated by the torque motor being transferred to the shaft and the drum of the pedal and resulting in the application of an active force on the pedal.

In one embodiment, the housing includes first and second housing portions defining respective first and second interior housing cavities separated by a housing wall, the drum of the pedal extends into the first interior cavity and the torque motor is located in the second interior cavity and is separated from the drum of the pedal by the housing wall, the housing wall defining a through-hole, the shaft extending through the through-hole in the housing wall.

In one embodiment, the pedal includes a pedal arm extending from the drum of the pedal in a direction and orientation generally normal to the longitudinal and rotational axes of the drum of the pedal, the longitudinal axis of the torque motor, and the shaft.

Other advantages and features of the present invention will be more readily apparent from the following detailed description of the preferred embodiment of the invention, the accompanying drawings, and the appended claims.

BRIEF DESCRIPTION OF THE DRAWINGS

These and other features of the invention can best be understood by the following description of the accompanying FIGURES in which.

DETAILED DESCRIPTION OF THE EMBODIMENT

Figure 1:
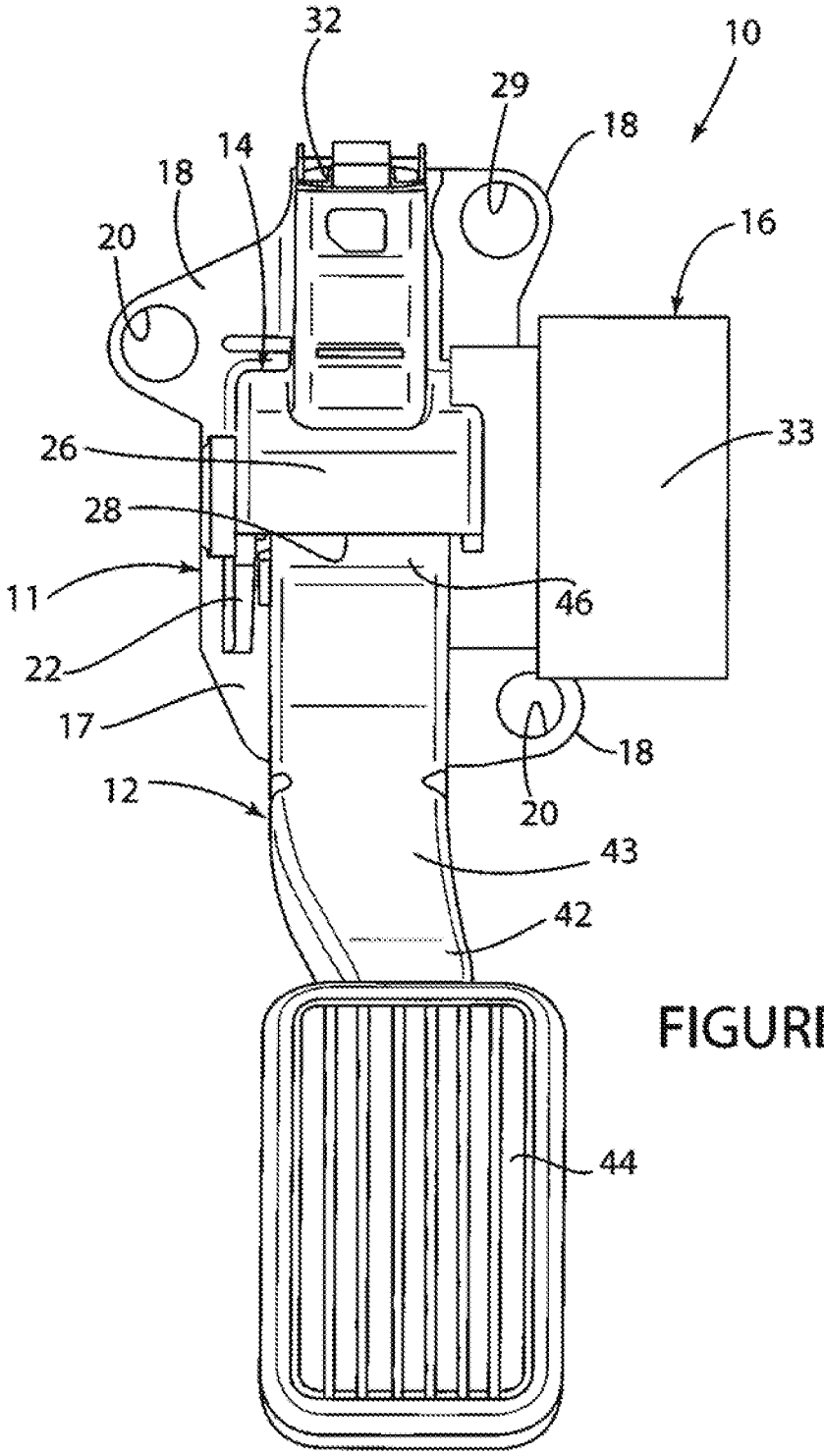
FIG. 1 is a front elevational view of an active force pedal assembly in accordance with the present invention.
Figure 2:
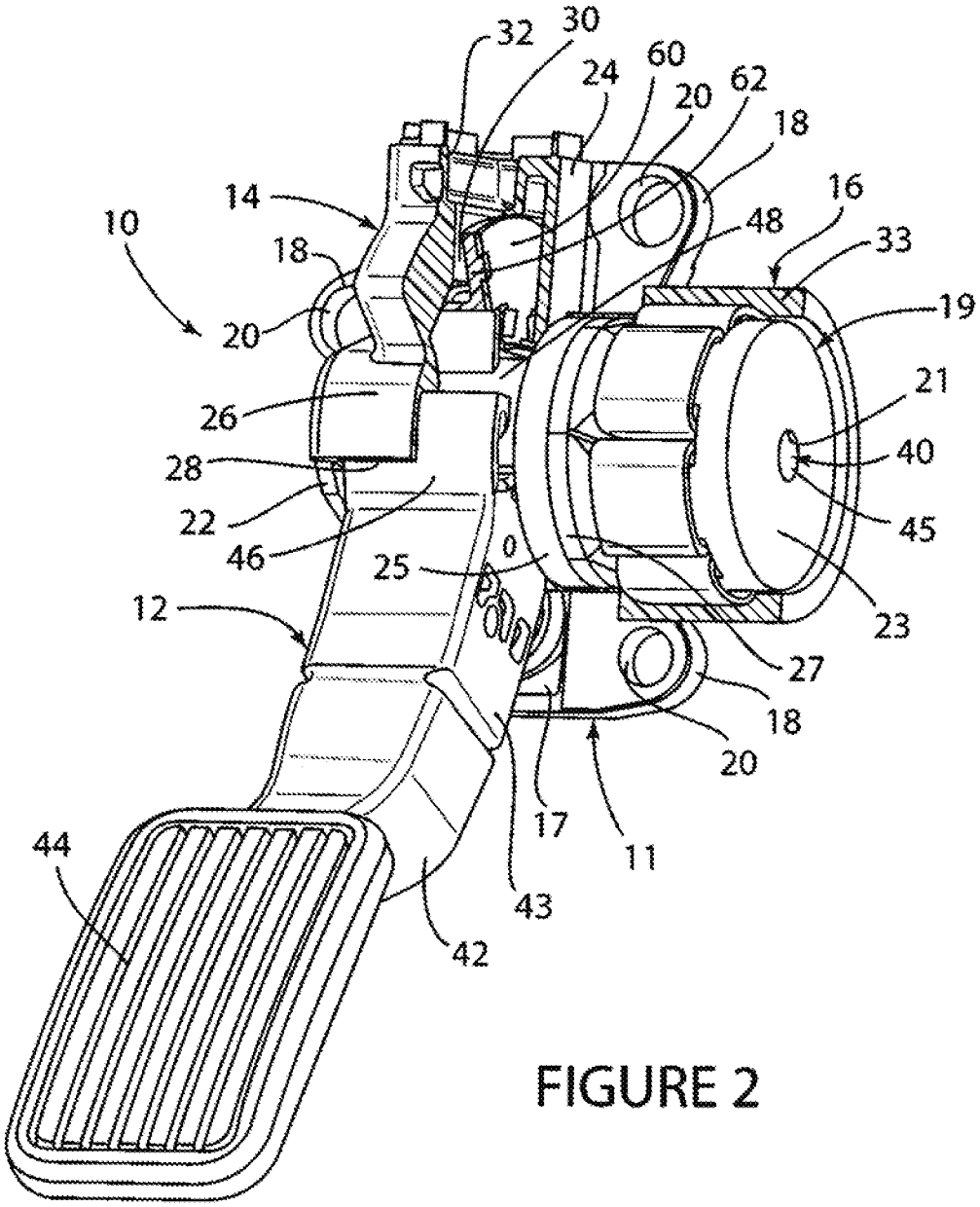
FIG. 2 is a perspective view, partly in cross-section, of the active force pedal assembly shown in FIG. 1.
Figure 3:
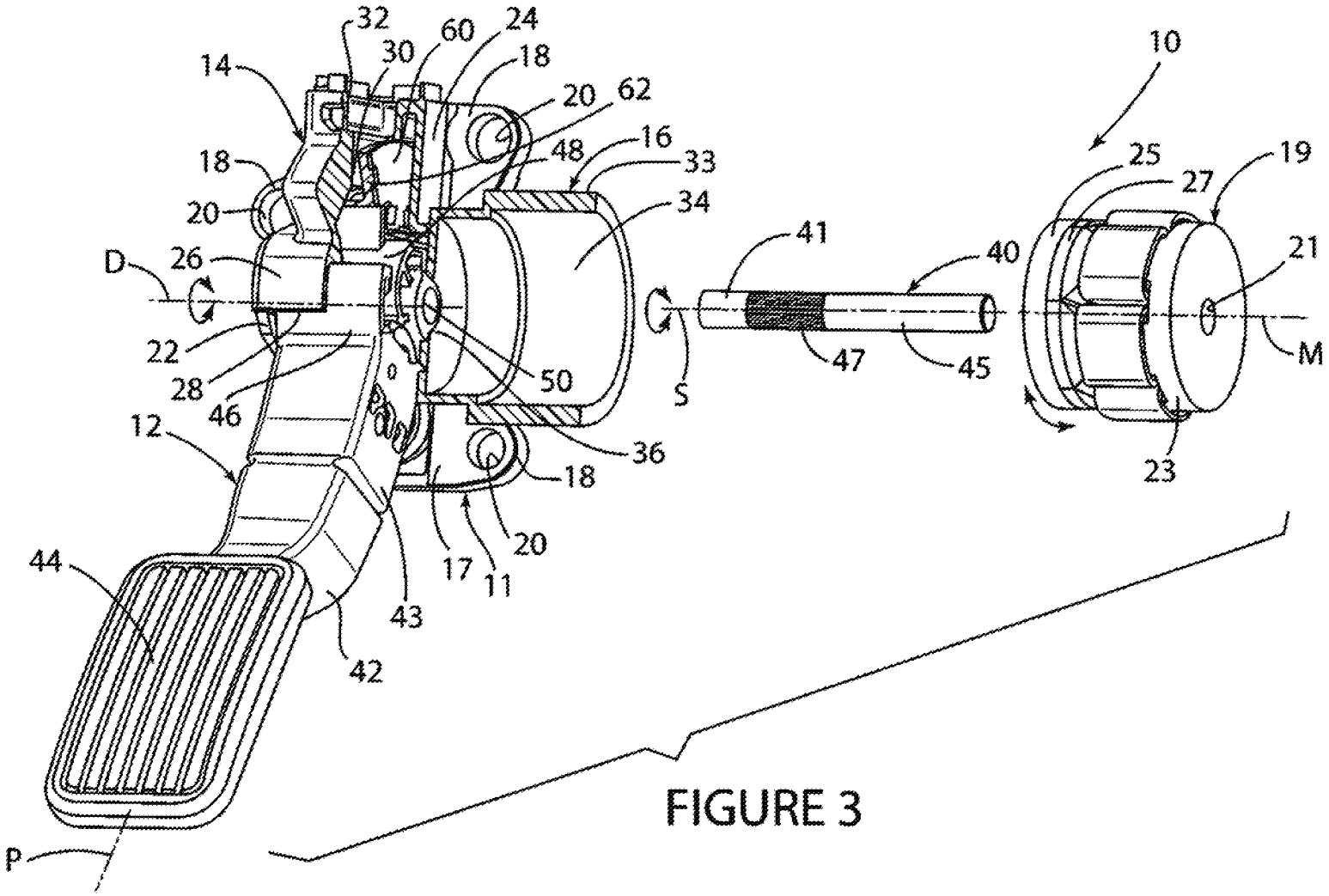
FIG. 3 is an exploded perspective view, partly in cross-section, of the active force pedal assembly shown in FIGS. 1 and 2.

FIGS. 1, 2, and 3 depict one embodiment of an active force vehicle accelerator pedal assembly 10 in accordance with the present invention.

The pedal assembly 10, which may be made of a suitable thermoplastic material, comprises an elongate pedal 12 and a housing 11 comprising a first pedal housing or housing portion 14 that houses the pedal 12 and a second motor housing or housing portion 16 that is unitary with the first pedal housing portion 14 and houses an active pedal force generating device 19 which, in the embodiment shown, is in the form of an electric torque motor 19.

The housing 11 includes a generally flat base plate 17 which, in the embodiment shown, has three brackets 18 defining respective apertures 20 for screws, bolts, or the like (not shown) that allow for securement of the pedal assembly 10 to the floor of a vehicle (not shown).

The housing 11, and more specifically the first pedal housing portion 14 thereof, includes a pair of side walls 22 and 24 extending unitarily generally normally outwardly from the top exterior surface of the base 17 in a generally spaced-apart and parallel relationship. The housing 11, and more specifically the first pedal housing portion 14 thereof, still further includes a top arcuate cover wall 26 extending between the top peripheral edge of the respective side walls 22 and 24 in a relationship spaced from the base 17 and together with the base 17 and the side walls 22 and 24 defining the first pedal housing portion 14; a front housing opening 28 in the housing 11, and more specifically in the first pedal housing portion 14, through which the drum 48 of the pedal 12 extends; a back or rear housing opening 32 in the first housing portion 14 for a connector assembly (not shown); and a first interior cavity 30 defined in the housing 11, and more specifically defined in the first pedal housing portion 14, for the drum 48 of the pedal 12 (FIGS. 2 and 3).

The housing portion 16 is, in the embodiment shown, generally cylindrically-shaped and defined by a circumferentially-extending wall 33 protruding unitarily and generally normally outwardly from the exterior surface of the side wall 24 of the housing 14 which, in combination with the side wall 24, defines a second interior cavity 34 in the housing portion 16 thus the housing 11 for the torque motor 19 (FIG. 3).

In the embodiment shown, the first and second housing portions 14 and 16 and the respective first and second housing cavities 30 and 34 are separated by the side wall 24 with the exception that the side wall 24 defines a central through aperture 36 (FIG. 3) adapted to receive an elongate and generally cylindrically shaped combination pedal/motor shaft 40 (FIG. 3) as described in more detail below.

The pedal 12 includes a proximal first end 42 with a foot plate 44, an elongate pedal arm 43, and an opposed distal second end 46 with a generally cylindrically shaped drum 48 (FIGS. 2 and 3) that extends through the front housing opening 28 and into the first interior housing cavity 30 of the housing portion 14 of the housing 11.

The drum 48 defines a central through-hole 50 (FIG. 3) terminating in respective openings in the opposed side faces of the drum 48 and adapted to receive a first elongate half end segment of the shaft 40 for mounting the drum 48, and thus the pedal 12, for pivotal movement in the cavity 30 relative to the side walls 22 and 24 and the base 17 and thus for pivotal movement relative to the first housing portion 14 and the housing 11.

In the embodiment shown, the pedal assembly 10 is a non-contacting sensor vehicle pedal assembly, of the type disclosed in for example U.S. Pat. No. 7,926,384 to Wum, the disclosure and description of which is incorporated herein by reference, that includes a magnet assembly 60 with a magnet 62 that protrudes outwardly from a front face of the drum 48 into the housing cavity 30 and extends in the direction of the rear opening 32 of the housing portion 14 (FIGS. 2 and 3).

Although not shown in any of the FIGURES but also disclosed in U.S. Pat. No. 7,926,384, the disclosure and description of which is again incorporated herein by reference, it is understood that the pedal assembly 10 also comprises a combination electrical connector/sensor assembly that is adapted to extend through the rear opening 32 of the housing 14 and into the housing cavity 30 in a relationship opposed and spaced from the magnet 62 of the magnet assembly 60.

The combination connector/sensor assembly includes a printed circuit board including a plurality of electrical components mounted thereon including one or more sensors such as, for example. Hall effect sensors designed to sense a change in the magnetic field generated by the magnet 62 in response to the pivotal movement of the magnet 62 and the pedal 12 for the purpose of sensing the pivotal position of the pedal 12 and controlling the vehicle's acceleration and deceleration.

It is understood however that the present invention is also adapted for use in any other type of pedal assembly in which the generation of an active force may be desirable including for example a contacting sensor vehicle pedal assembly of the type disclosed in U.S. Pat. No. 8,042,430 to Campbell, the disclosure and description of which is incorporated herein by reference.

The active pedal force generating device 19, which in the embodiment shown is in the form of a generally cylindrically-shaped electric torque motor 19, is located and mounted in the interior cavity 34 of the housing portion 16 of the housing 11 in a relationship wherein the side wall 24 of the housing 14 separates the torque motor 19 in the cavity 34 of the housing portion 16 from the pedal 12 in the cavity 30 of the housing portion 14 of the housing 11.

Although not shown or described herein in any detail, it is understood that, as shown in FIGS. 2 and 3, the torque motor 19 may be of a construction that includes a stationary generally cylindrically shaped stator 23 and a generally cylindrically shaped rotor 25 that is rotatable relative to the stator 23 and to which the second elongate half segment of the shaft 40 is adapted to be coupled. The rotor 25 includes a ring-shaped magnet 27 coupled thereto that is adapted for interaction with the electrical field generated by the stator 23 during operation of the torque motor 19 for causing the rotation of the rotor 25 and thus the rotation of the shaft 34 adapted to be coupled thereto.

In the embodiment and orientation of the pedal assembly 10 as shown in the FIGURES, the pedal 12 and the torque motor 19 are positioned and oriented relative to each other in a relationship wherein the drum 48 of the pedal 12 and the torque motor 19 are disposed in a side-by-side, adjacent, and parallel horizontal relationship on opposite sides of the housing wall 24; the drum 48 defines a horizontally extending longitudinal and rotational axis D that extends through the through-hole 50 defined therein and is disposed in a relationship generally co-linear with the horizontally extending longitudinal axis M of the torque motor 19 and extending through the through-hole 21 defined therein; and the longitudinal axis P of the pedal 12 extends in an orientation and direction generally normal to the longitudinal axes D and M of the drum 48 and the torque motor 19 respectively.

In the embodiment and orientation of the pedal assembly 10 as shown in the FIGURES and more particularly as shown in FIG. 3, the elongate and generally cylindrically shaped metal combination pedal/torque motor shaft 40 includes first and second opposed and unitary end or half shaft segments 41 and 45. The segment 41 includes an exterior circumferentially extending knurled or serrated surface 47.

Although FIG. 3 depicts the shaft 40 and the torque motor 19 in exploded view, it is understood that, in the assembled and operational configuration of the pedal assembly 10, the shaft 40 is located and extends in the interior of the housing 11 in a generally horizontal relationship wherein the first end or half segment 41 extends into and is coupled to the drum 48 of the pedal 12 and the second end or half segment 45 extends into and is adapted to be coupled to the rotor 25 of the torque motor 19 and still more specifically in a relationship in which the shaft 40 extends through the aperture 36 defined in the side wall 24 of the housing 1; the first end or half shaft segment 41 of the shaft 40 extends into and through the interior cavity 30 of the housing portion 14, and more specifically, into and through the through-hole 50 defined in the drum 48 of the pedal 12 and is secured and coupled to the drum 48 as by for example pressing and meshing of the metal knurled surface 47 on the shaft segment 41 into the plastic material of the drum 48 of the pedal 12; and the second end or half shaft segment 45 of the shaft 40 extending into and through the interior cavity 34 of the housing portion 16, and more specifically, into and through the through-hole 21 defined in the torque motor 19.

Thus, in the embodiment shown, the torque motor 19 is coupled to the drum 48 of the pedal 12 in a direct drive or coupling relationship via the shaft 40 which is coupled to both the torque motor 19 and the drum 48 of the pedal 12 and in which the shaft 40, in the embodiment shown, defines a longitudinal axis S which is disposed and oriented in a relationship generally co-linear with the longitudinal axes M and D of the torque motor 19 and the drum 48 of the pedal 12 respectively.

Moreover, in the embodiment shown, the pedal 12 and the pedal arm 43 define a longitudinal axis P that is oriented and extends in a direction and relationship generally normal to the longitudinal and rotational axes D of the drum 48 of the pedal 12, the longitudinal axis M of the torque motor 19, and the longitudinal axis S of the shaft 40.

The torque motor 19 is adapted for operation or activation in response to specific commands from the vehicle ECM or by supplied power behavior as a result of a variety of vehicle conditions or events including, for example, a vehicle exceeding a recommended speed or speed limit, or a vehicle not keeping a safe distance behind another vehicle, or a vehicle sensing the presence of an object behind the vehicle when operating the vehicle in reverse, or a vehicle losing traction, or a vehicle not being operated in a fuel efficient manner.

Operation or activation of the torque motor 19 causes the clockwise and/or counter-clockwise rotation of the rotor 25 of the torque motor 19 which, in turn, generates and applies a clockwise and/or counter-clockwise rotational torque force or movement to the combination pedal/torque motor shaft 40 coupled directly to the rotor 25 of the torque motor 19 which rotational force and torque, in turn, is transferred to the opposed end segment 41 of the shaft 40 which is coupled directly to the drum 48 of the pedal 12 which rotational force and torque, in turn, is transferred to the drum 48 of the pedal 12 which, in turn, results in the transfer and application of an active feedback or push back force on the pedal 12 and the foot of the operator via the foot plate 44, thus providing the operator with a sensory indication or signal to remove his/her foot from the pedal 12 and respond to the vehicular condition or event.

For example, the pedal assembly 10 can be configured for operation in a relationship and manner wherein the torque motor 19 causes the clockwise rotation of the rotor 25 which, in turn, causes the clockwise rotation of the shaft 40 which, in turn, causes the clockwise rotation of the drum 48 of the pedal 12 which, in turn, causes the transfer and application of an active feedback or push back force on the pedal 12 and the foot of the operator via the foot plate 44 that arrests the downward, inward, counter-clockwise acceleration movement of the pedal 12 and causes the reverse upward, outward, and clockwise movement of the pedal 12 to decelerate the vehicle and return the pedal 12 to its idle neutral position.

The torque motor 19 can be coupled and connected to the shaft 40 and the pedal 12 in a direct drive arrangement either mechanically or magnetically. The torque motor 19 could also be connected to the shaft 40 and the pedal 12 via an intermediate gear train or other type of intermediate mechanism including a mechanism that allows decoupling of the shaft 40 from the torque motor 19 if necessary or as desired.

Although not shown or described herein in any detail, it is understood that the second end of half segment 45 of the shaft 40 that is coupled to the rotor 25 of the torque motor 19 can likewise include a knurled exterior surface similar to the knurled exterior surface 47 on the first end or half segment 41 of the shaft 40 that would be pressed into the material of the rotor 25 to insure a secure coupling of the shaft 40 to the rotor 25 of the torque motor 19.

Moreover, and although also not shown or described in any detail, it is also understood that in such applications in which it may be desirable to allow the shaft 40 to be decoupled from the rotor 25 of the torque motor 19 during operation, the knurl on the exterior surface of the second end or half shaft segment 45 could be removed and substituted with a one way bearing or Sprague that would be pressed into the rotor 25. This bearing would support the shaft 40 for rotation with the rotor 25 in one direction only, such as for example the clockwise direction shown in FIG. 3, but would slip and become decoupled from the rotor 25 in the opposite direction such as for example the counter-clockwise direction in FIG. 3.

The torque motor 19 can be of any suitable multiple pole stator design such as, for example, a two pole gear drive design or a six pole design as shown in the FIGURES and connected and coupled to the shaft 40 and the pedal 12 in a direct drive arrangement.

It is further understood that the concept of the present invention is likewise applicable to a brake or clutch pedal and that the torque motor 19 could be either a non-intelligent motor or a "smart" motor operable and controllable via electronics integrated in the pedal assembly 10 including, for example, electronics mounted on a printed circuit board in the interior housing of the pedal assembly 10 or directly mounted to the torque motor 19. It is still further understood that the electrical connector assembly for the torque motor 19 can be either integrated as part of the pedal assembly connector assembly or a separate connector assembly dedicated for the torque motor 19.

Numerous variations and modifications of the embodiment described above may be effected without departing from the spirit and scope of the novel features of the invention. It is to be understood that no limitations with respect to the specific active force pedal assembly illustrated herein are intended or should be inferred. It is, of course, intended to cover by the appended claims all such modifications as fall within the scope of the claims.

We claim:

1. An active force pedal assembly comprising;

a housing;

a pedal including an end mounted in the housing for pivotal movement relative to the housing, the end of the pedal mounted in the housing including a drum;

a torque motor adapted to generate a rotational force, the drum of the pedal and the torque motor being disposed in a horizontal side-by-side relationship and defining respective co-linearly aligned longitudinal axes; and a shaft having a first end extending into and coupled to the drum of the pedal and an opposed end extending into and adapted for coupling with the torque motor, the rotational force generated by the torque motor being transferred to the shaft and resulting in the application of an active force on the pedal.

2. An active force pedal assembly comprising;

a housing defining an interior cavity;

a pedal including a drum extending into the interior cavity of the housing, the drum defining a longitudinal and rotational axis and adapted for pivotal movement in the interior cavity of the housing about the longitudinal and rotational axis relative to the housing;

a torque motor adapted to generate a rotational force, the torque motor being located in the interior cavity of the housing and defining a longitudinal axis disposed in a co-linear relationship with the longitudinal and rotational axis of the drum of the pedal; and an elongate shaft in the housing having a first end extending into and coupled to the drum of the pedal and an opposed end extending into and adapted for coupling to the torque motor, the rotational force generated by the torque motor being transferred to the shaft and the drum of the pedal and resulting in the application of an active force on the pedal.

3. The active force pedal assembly of claim 2, wherein the housing includes first and second housing portions defining respective first and second interior housing cavities separated by a housing wall, the drum of the pedal extending into the first interior cavity and the torque motor being located in the second interior cavity and is separated from the drum of the pedal by the housing wall, the housing wall defining a through-hole, the shaft extending through the through-hole in the housing wall.

4. The active force pedal assembly of claim 3, wherein the pedal includes a pedal arm extending from the drum of the pedal in a direction and orientation substantially perpendicular to the longitudinal and rotational axes of the drum of the pedal, the longitudinal axis of the torque motor, and the shaft.

* * * * *